US007077251B1

(12) United States Patent
Gaither

(10) Patent No.: US 7,077,251 B1
(45) Date of Patent: Jul. 18, 2006

(54) DESIGNER COVER FOR LUGGAGE

(76) Inventor: Richard L Gaither, 2804 Erie St., Southeast, Washington, DC (US) 20020

( * ) Notice: Subject to any disclaimer, the term of this patent is extended or adjusted under 35 U.S.C. 154(b) by 44 days.

(21) Appl. No.: 10/852,624

(22) Filed: May 24, 2004

(51) Int. Cl.
*A45C 13/08* (2006.01)

(52) U.S. Cl. ..... 190/26; 150/105; 150/154

(58) Field of Classification Search ..... 150/154, 150/103, 105; 383/111; D3/318, 319, 321; 190/26
See application file for complete search history.

(56) References Cited

U.S. PATENT DOCUMENTS

| | | | | | |
|---|---|---|---|---|---|
| 656,707 | A | * | 8/1900 | Welshe | 190/26 |
| 796,286 | A | * | 8/1905 | Bottesse | 190/26 |
| 1,526,839 | A | | 2/1925 | Dempsey | |
| 1,783,275 | A | * | 12/1930 | Berwin | 150/106 |
| 2,432,365 | A | | 12/1947 | Allen | |
| 2,487,596 | A | * | 11/1949 | Sackstein | 190/26 |
| 2,617,504 | A | | 11/1952 | Meyers | |
| 2,711,234 | A | | 6/1955 | Rubens | |
| 2,724,467 | A | * | 11/1955 | Jaffe | 190/26 |
| 2,732,046 | A | | 1/1956 | Smallberg | |
| 3,901,360 | A | | 8/1975 | Cook | |
| 4,200,133 | A | * | 4/1980 | Whitlow | 150/159 |
| 5,010,987 | A | * | 4/1991 | Evans | 190/26 |
| 5,083,644 | A | | 1/1992 | Collins, III | |
| 5,154,332 | A | * | 10/1992 | Williams et al. | 224/153 |
| 5,172,795 | A | | 12/1992 | Riceman | |
| 5,255,765 | A | | 10/1993 | Schrecongost | |
| 5,293,975 | A | | 3/1994 | Howorka | |
| D358,023 | S | * | 5/1995 | Poire | D3/217 |
| D422,404 | S | * | 4/2000 | Hasas | D3/216 |
| D448,923 | S | * | 10/2001 | Willingham et al. | D3/216 |
| 6,311,885 | B1 | * | 11/2001 | Miller | 224/652 |
| 6,637,562 | B1 | * | 10/2003 | Oh | 190/26 |
| D491,361 | S | * | 6/2004 | Bernbaum et al. | D3/279 |
| 2001/0038023 | A1 | * | 11/2001 | Trevino | 224/153 |
| 2004/0206431 | A1 | * | 10/2004 | Metzig et al. | 150/154 |
| 2005/0051247 | A1 | * | 3/2005 | Johnson | 150/154 |

FOREIGN PATENT DOCUMENTS

| | | | | |
|---|---|---|---|---|
| CA | 1.287.817 | | | 8/1987 |
| GB | 2147497 | A | * | 5/1985 |
| GB | 2167656 | A | * | 6/1986 |
| GB | 2253781 | A | * | 9/1992 |
| WO | WO00/05990 | | | 2/2000 |

* cited by examiner

*Primary Examiner*—Sue A. Weaver
(74) *Attorney, Agent, or Firm*—Michael I Kroll

(57) ABSTRACT

An apparatus for an easy to identify, flexible, foldable tubular-like cover 12 for suitcases 14 having elastic 16 positioned within at least one distal end and having a slot 22 for a handle, slot 28 for wheels, a plurality of pockets 34, pouches 26 and umbrella pouch 30 and an additional element comprising a zippered 38 flap 36 providing access to the interior without the necessity of removing the cover. The device 10 allows a user to easily recognize their luggage at airports, bus terminals, train stations and hotels by the personal cover design 20 of the device. The device 10 is washable, lightweight and foldable for easy storage when not in use.

2 Claims, 10 Drawing Sheets

DESIGNER COVER FOR LUGGAGE

BACKGROUND OF THE INVENTION

1. Field of the Invention

The present invention relates generally to covers and, more specifically, to an easy to identify, flexible, foldable tubular like cover for suitcases having elastic positioned within at least one distal end and having a slot for a handle, slot for wheels, a plurality of pockets, pouches and, umbrella pouch and an additional element comprising a zippered flap providing access to the interior without the necessity of removing the cover. The device allows a user to easily recognize their luggage at airports, bus terminals, train stations and hotels by the personal cover design of the device. The device is washable, lightweight and foldable for easy storage when not in use.

2. Description of the Prior Art

There are other luggage covers designed for suitcases. Typical of these is U.S. Pat. No. 2,711,234 issued to Rubens on Jun. 21, 1955.

Another patent was issued to Dempsey on Feb. 17, 1925 as U.S. Pat. No. 1,526,839. Yet another U.S. Pat. No. 2,432,365 was issued to Allen on Dec. 9, 1947 and still yet another was issued on Nov. 11, 1952 to Meyers as U.S. Pat. No. 2,617,504.

Another patent was issued to Smallberg on Jan. 24, 1956 as U.S. Pat. No. 2,732,046. Yet another U.S. Pat. No. 3,901,360 was issued to Cook on Aug. 26, 1975. Another was issued to Collins III on Jan. 28, 1992 as U.S. Pat. No. 5,083,644 and still yet another was issued on Dec. 22, 1992 to Riceman U.S. Pat. No. 5,172,795.

Another patent was issued to Schrecongost on Oct. 26, 1993 as U.S. Pat. No. 5,255,765. Yet another U.S. Pat. No. 5,293,975 was issued to Howorka on Mar. 15, 1994. Another was issued to Hyun on Aug. 20, 1991 as Canadian Patent No. 1,287,817 and still yet another was filed Feb. 10, 2000 by Santy as WIPO Publication No. WO 00/5990.

U.S. Pat. No. 2,711,234

Inventor: David Rubens

Issued: Jun. 21, 1955

An adjustable cover for luggage comprising a tube of textile fabric open at the ends, said tube having in the mesh thereof elastic strands capable of approximately 100% stretch, disposed along the circumferential dimensions of the tube, so as to allow circumferential stretching of the cover to snugly encompass luggage of various sizes from the smallest to substantially the largest of any particular type; there being a slit along the longitudinal direction of the tube intermediate the length thereof for the protrusion therethrough of the handle of the luggage piece; the tube being of a length sufficient to accommodate the largest size of luggage of said type and adapted to be tucked over the ends of smaller sized luggage pieces.

U.S. Pat. No. 1,526,839

Inventor: Mary Dempsey

Issued: Feb. 17, 1925

A cover for baggage comprising two pieces of flexible material adapted to be partly of flexible material adapted to be partly superimposed and of a shape when engaged along their edges to enclose an article of baggage, connecting means for said edges comprising a plurality of rows of snaps on said pieces constructed and adapted to join said pieces to enclose a plurality of sizes of baggage, a top opening in said closure for a baggage handle to pass through and a flap to cover said opening under said flap.

U.S. Pat. No. 2,432,365

Inventor: Mannie Allen

Issued: Dec. 9, 1947

The combination with a hand carried case having a top opening and handles located on either side of the top opening, of a cover for the case having side walls and end walls connected to each other, and a bottom wall and a divided top wall connected to the end walls and to the side walls, the divided top wall being provided with a slide fastener located over the top opening of the case and the side walls being provided with openings to allow the handles of the case to project outwardly of the cover, a flap for substantially closing these openings secured at one end to one of the side walls of the cover and having detachable connection with the other side wall of the cover, one side wall being connected to one side edge of the bottom wall of the cover, and a slide fastener connecting the other side wall to the opposite side edge of the bottom wall, the cover being constructed to be slipped over the case by releasing the slide fastener-last named from closing position to allow the adjacent connectable edges of the engaged side wall and bottom wall to be separated from each other to provide an opening at the base of the cover large enough to receive the case.

U.S. Pat. No. 2,617,504

Inventor: Irving Joseph Meyers

Issued: U.S. Pat. No. 2,617,504

An expansible protective cover for snugly enclosing an article of luggage or the like, having top, bottom, back and side surfaces and of the type having two receptacle-like parts hinged together along the back surface, said cover comprising flexible material for covering the top, back and bottom surfaces of the article, elastic flexible material extending over the side surfaces of the article and from one end of said back to the opposite end thereof, and stretchable in a direction between top and bottom and joined to opposing adjacent edges of the material which covers the top and bottom surfaces, said elastic portion being divided into two parts along a line parallel to the adjacent marginal edges of the covering material for said top and said bottom, and each part of said elastic portion being adapted to elastically embrace the corresponding side of the article of luggage in both the open and closed positions, and slidable fastening means extending substantially throughout the length of said elastic portion, whereby one edge of an elastic portion may be secured to the adjacent edge of the other part of said divided elastic portion.

U.S. Pat. No. 2,732,046

Inventor: Harry Smallberg

Issued: Jan. 24, 1956

A cover for an article of luggage of the character described comprising a unitary bottom wall of substantially rectangular shape, side walls of flexible inelastic woven fabric, each connected by one edge to an edge of said bottom wall and a pair of gusset sections each forming top and end wall portions of the cover and each consisting of an outer portion of inelastic woven fabric extending from the side and top edges of said wall and from an end edge of the bottom wall and a continuous elastic strip connected by one longitudinal edge to the contiguous edge of the inelastic fabric portion of the gusset and by its end edges to the end edges of the bottom wall and having slide fastener tape, connected to the other longitudinal edge thereof.

U.S. Pat. No. 3,901,360

Inventor: Mary Cook

Issued: Aug. 26, 1975

A luggage protector having closure means extending around the periphery thereof to the opposite ends of an opening adapted for protrusion of a luggage handle therethrough.

U.S. Pat. No. 5,083,644

Inventor: Cecil B. Collins III

Issued: Jan. 28, 1992

A flexible foldable cover for a briefcase to shield the briefcase exterior surface from the damaging effects of rain. The cover is a rectangular bottomless hood structure having interior dimensions slightly greater than the exterior dimensions of the briefcase, such that the hood structure can be slipped downwardly over the briefcase when there is a threat of rain. When the cover is not needed it can be folded into a small size package and stored in the briefcase.

U.S. Pat. No. 5,172,795

Inventor: Robert G. Riceman

Issued: Dec. 22, 1992

A protective cover for a handled carrying container is constituted by a pair of opposed side walls having a size greater than the corresponding walls of the carrying container and having top, side and bottom edges, the top edges and the side edges of the respective side walls being joined to each other, the bottom edges being unjoined. A handle receiving aperture is provided where the top edges are joined. A handle engaging sleeve or elastic collar is provided around the handle receiving aperture for engaging a container handle in substantially watertight engagement.

U.S. Pat. No. 5,255,765

Inventor: Deborah Schrecongost

Issued: Oct. 26, 1993

Embodiments of a removable luggage cover are disclosed, each for protecting a piece of luggage from damaging and dirty environments. The luggage cover is a piece of durably woven fabric held on the luggage either by being directly attached to the luggage with clips or buckles or by enveloping the luggage and being clipped or buckled together. No zipper for an envelope nearly completely enclosing the luggage is required. The luggage cover allows access and use of the luggage handle while the cover is in place, and is adjustable to luggage of different sizes and shapes.

U.S. Pat. No. 5,293,975

Inventor: David J. Howorka

Issued: Mar. 15, 1994

A universal briefcase protector for use with briefcases of various sizes and shapes. The briefcase protector of the present invention protects both the body of the briefcase as well as the handles. Additionally, the briefcase protector allow for normal carrying of the briefcase even when the protector is employed.

Canadian Patent Number 1,287,817

Inventor: Hyun S. Kim

Issued: Aug. 8, 1991

A front cover with a pocket for a carrying case comprising a backing sheet with an array of panel sections and a pocket overlapping the edges of the panels and the exposed area of the backing sheet such that the pocket is a single thickness of the skin material. Gussets are made along the longitudinal sides of the pocket so that it extends outwardly on the front cover. Securement of the pocket and panel sections onto the backing sheet is done by sewing and including the panel and pocket into the welt around the outer peripheral edge of the front cover.

WIPO Publication No. 00/05990

Inventor: Dirk Santy

Published: Feb. 10, 2000

A luggage case having a large pocket carried by the main packing door. The pocket is formed by portions of the rail releasably attached to the main case by a sinuous path zipper track and a gusset along the lower, self hinged portion of the door. The resulting compartment protrudes into the interior of the case, and over at least one of the wheels, thus providing good organization within the case while helping to keep the case balanced on the wheels.

While these luggage protective devices may be suitable for the purposes for which they were designed, they would not be as suitable for the purposes of the present invention, as hereinafter described.

The present invention provides an easy to identify, flexible, foldable tubular like cover for suitcases having elastic positioned within at least one distal end and having a slot for a handle, slot for wheels, a plurality of pockets, pouches, an umbrella pouch and an additional element in the form of a zippered flap providing access to the interior without having to remove the cover. The device allows a user to easily recognize their luggage at airports, bus terminals, train stations and hotels by the personal cover design of the device. The device is washable, lightweight and foldable for easy storage when not in use.

SUMMARY OF THE PRESENT INVENTION

The present invention discloses an easy to identify, flexible, foldable tubular-like cover for suitcases having elastic positioned within at least one distal end and having a slot for a handle, slot for wheels, a plurality of pockets, pouches and umbrella pouch and an additional element comprising a zippered flap providing access to the interior without the necessity of removing the cover. The device allows a user to easily recognize their luggage at airports, bus terminals, train stations and hotels by the personal cover design of the device. The device is washable, lightweight and foldable for easy storage when not in use.

A primary object of the present invention is to provide an easy to identify, flexible, tubular like cover for suitcases.

Another object of the present invention is to provide a tubular cover for suitcases having a plurality of patterns, prints, fabrics, materials and/or graphic images whereby a user can easily identify their luggage when using the present invention.

Yet another object of the present invention is to provide an easy to identify, flexible, foldable tubular like cover for suitcases having elastic positioned within at least one distal end.

Still yet another object of the present invention is to provide an easy to identify tubular like cover for suitcases having a slot for a handle, slot for wheels, a plurality of pockets, pouches and an umbrella pouch.

Another object of the present invention is to provide an easy to identify tubular like cover for suitcases that the device allows a user to easily recognize their luggage at airports, bus terminals, train stations and hotels by the personal cover design of the device.

Yet another object of the present invention is to provide an easy to identify, flexible, foldable tubular like cover for suitcases having an access flap with a zipper that opens to provide access to the luggage within.

Additional objects of the present invention will appear as the description proceeds.

The present invention overcomes the shortcomings of the prior art by providing an easy to identify, flexible, foldable tubular like cover for suitcases having elastic positioned within at least one distal end and having a slot for a handle, slot for wheels, a plurality of pockets, pouches and an umbrella pouch. The device allows a user to easily recognize their luggage at airports, bus terminals, train stations and hotels by the personal cover design of the device. The device is washable, lightweight and foldable for easy storage when not in use.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

FIGS. 9A, 9B, 9C, and 9D show a plurality of possible designs of the present invention for easy identification.

Figure 10:
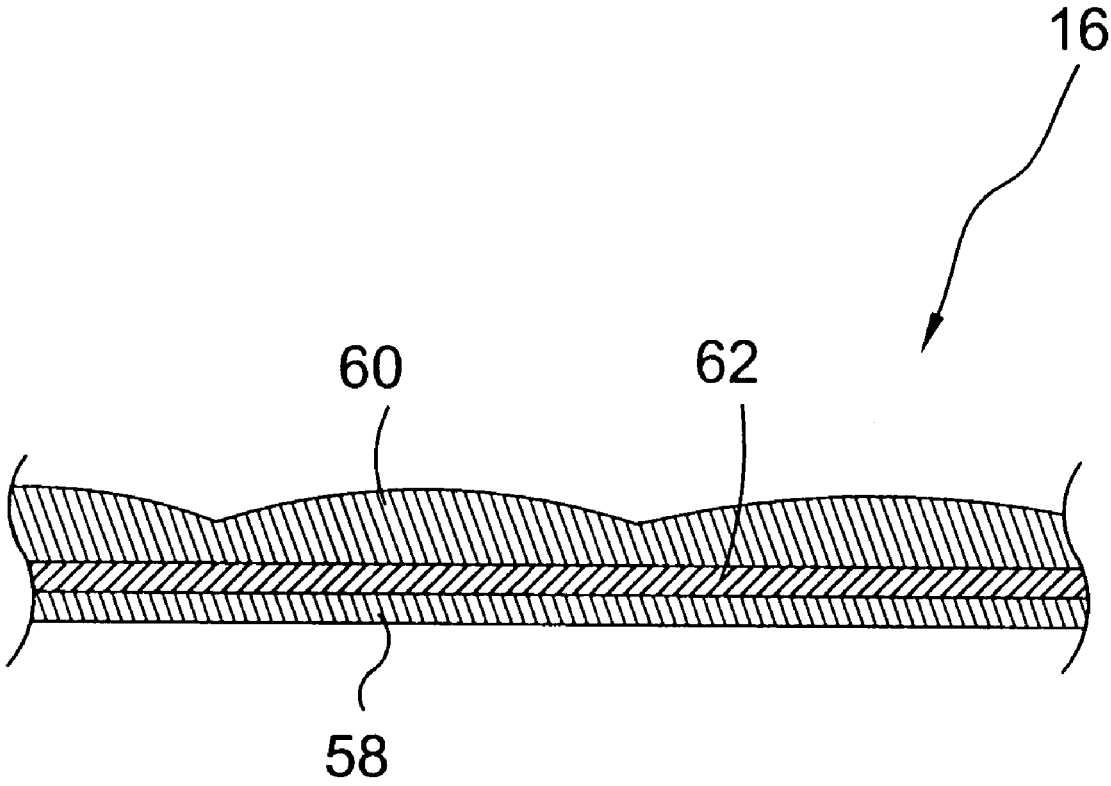

FIG. 10 is a sectional view of the present invention's elastic band.

LIST OF REFERENCE NUMERALS

With regard to reference numerals used, the following numbering is used throughout the drawings.

| | |
|---|---|
| 10 | present invention |
| 12 | cover |
| 14 | suitcase |
| 16 | elastic |
| 18 | aperture |
| 20 | design |
| 22 | handle aperture |
| 24 | suitcase opening |
| 26 | magazine pouch |
| 28 | wheel aperture |
| 30 | umbrella pouch |
| 32 | handle |
| 34 | pockets |
| 36 | access flap |
| 38 | zipper |
| 40 | keys |
| 42 | money |
| 44 | passport |
| 46 | magazines |
| 48 | maps |
| 50 | umbrella |
| 52 | colored |
| 54 | characters |
| 56 | sports |
| 58 | inner cloth layer |
| 60 | outer cloth layer |
| 62 | elastic member |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Figure 1:
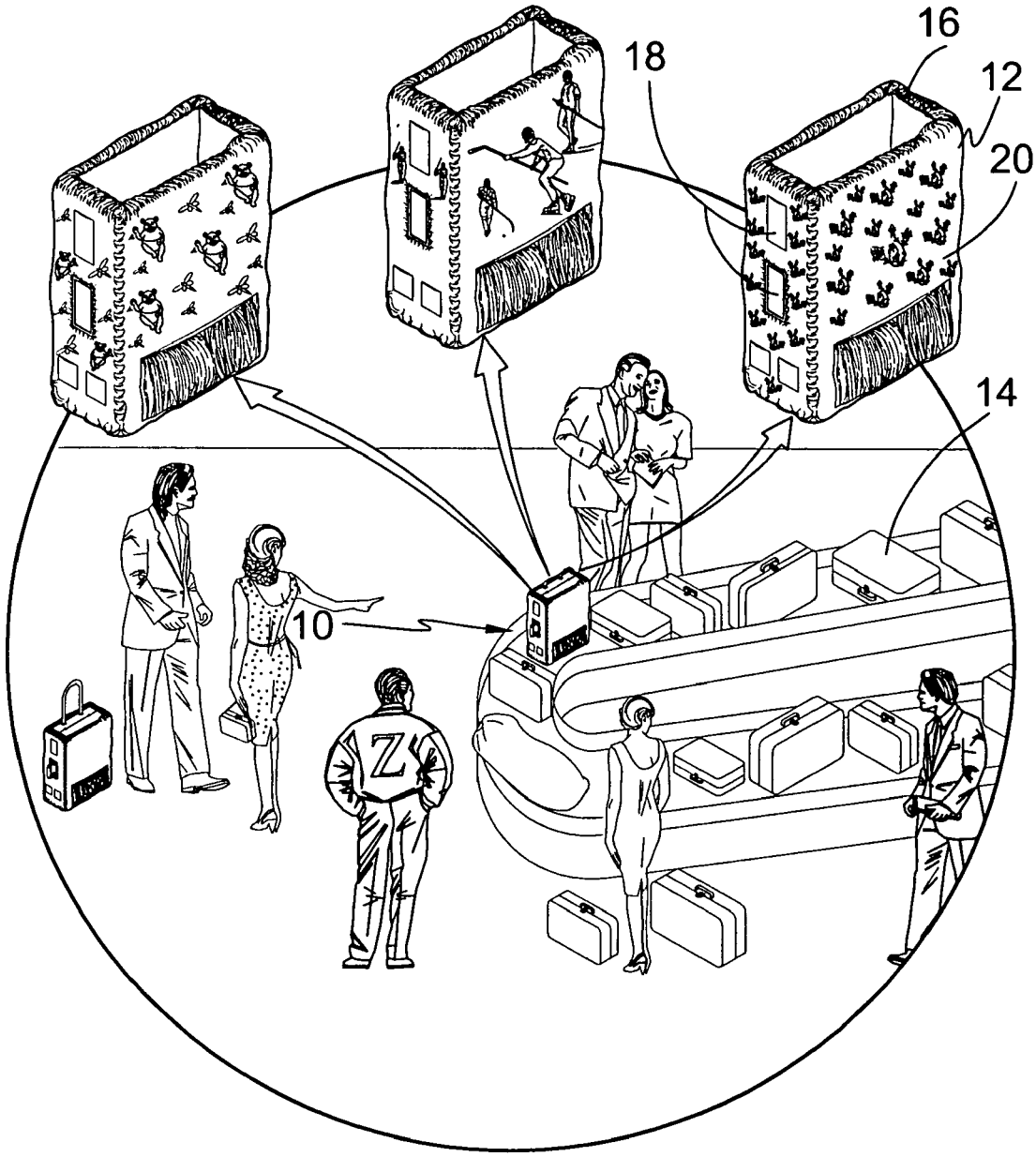
FIG. 1 is an illustrative view of the present invention in use.

Turning to FIG. 1, shown therein is an illustrative view of the present invention 10 in use. The present invention 10 comprises an easy to identify, flexible, foldable tubular like cover 12 for suitcases 14 having elastic 16 positioned within at least one distal end and having apertures 18 for a handle, wheels, a plurality of pockets, pouches and an umbrella pouch. The device 10 allows a user to easily recognize their luggage at airports, bus terminals, train stations and hotels by the personal cover design 20 of the device. The device 10 is washable, lightweight and foldable for easy storage when not in use.

Figure 2:
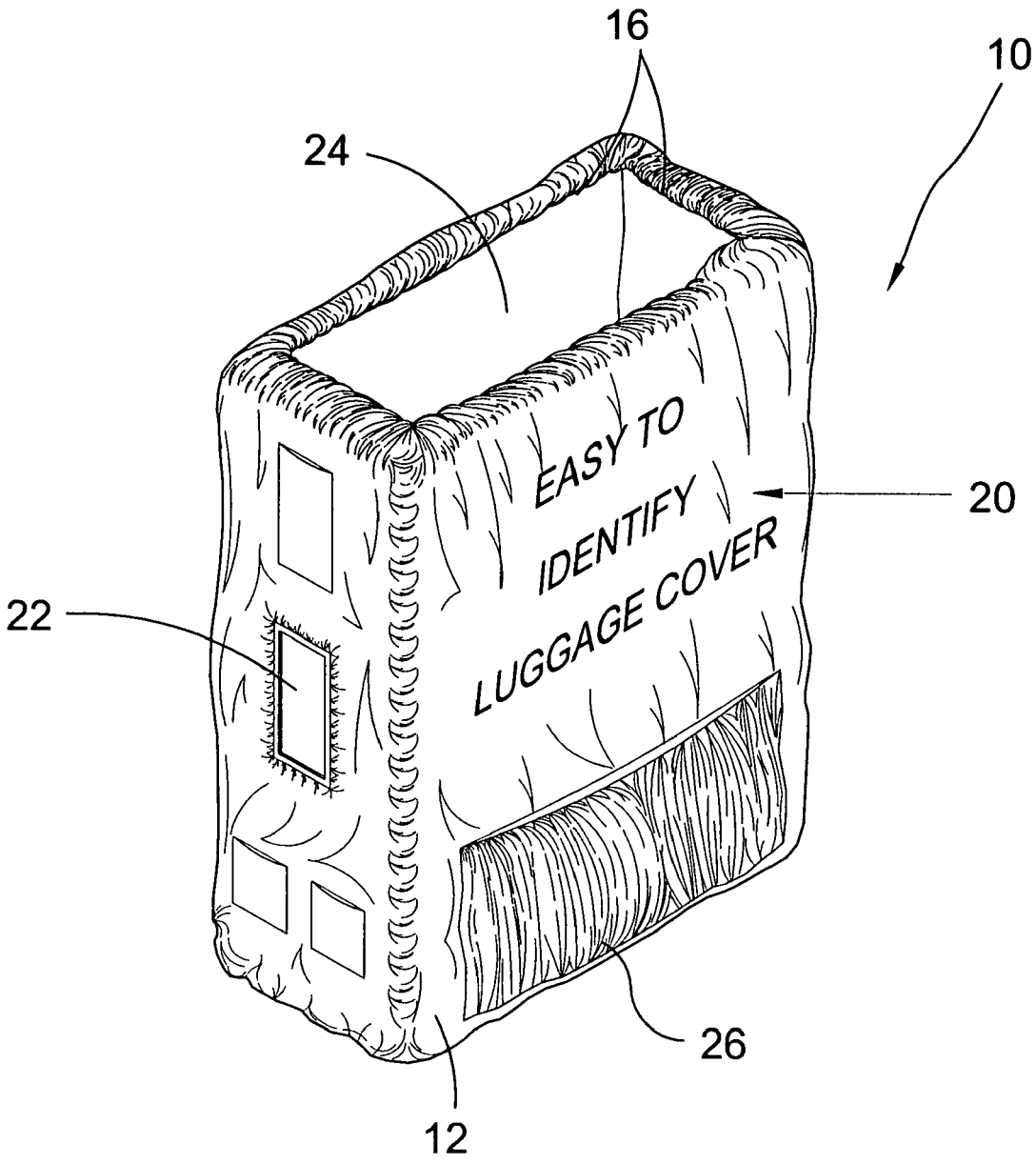
FIG. 2 is a front perspective view of the present invention.

Turning to FIG. 2, shown therein is a front perspective view of the present invention 10. The present invention 10 comprises an easy to identify, flexible, foldable tubular like cover 12 open at 24 for suitcases having elastic 16 positioned within at least one distal end and having apertures for a handle 22, wheels, a plurality of pockets, pouches 26 and an umbrella pouch. The device 10 allows a user to easily recognize their luggage at airports, bus terminals, train stations and hotels by the personal cover design at 20 of the device. The device 10 is washable, lightweight and foldable, e.g., cloth, for easy storage when not in use.

Figure 3:
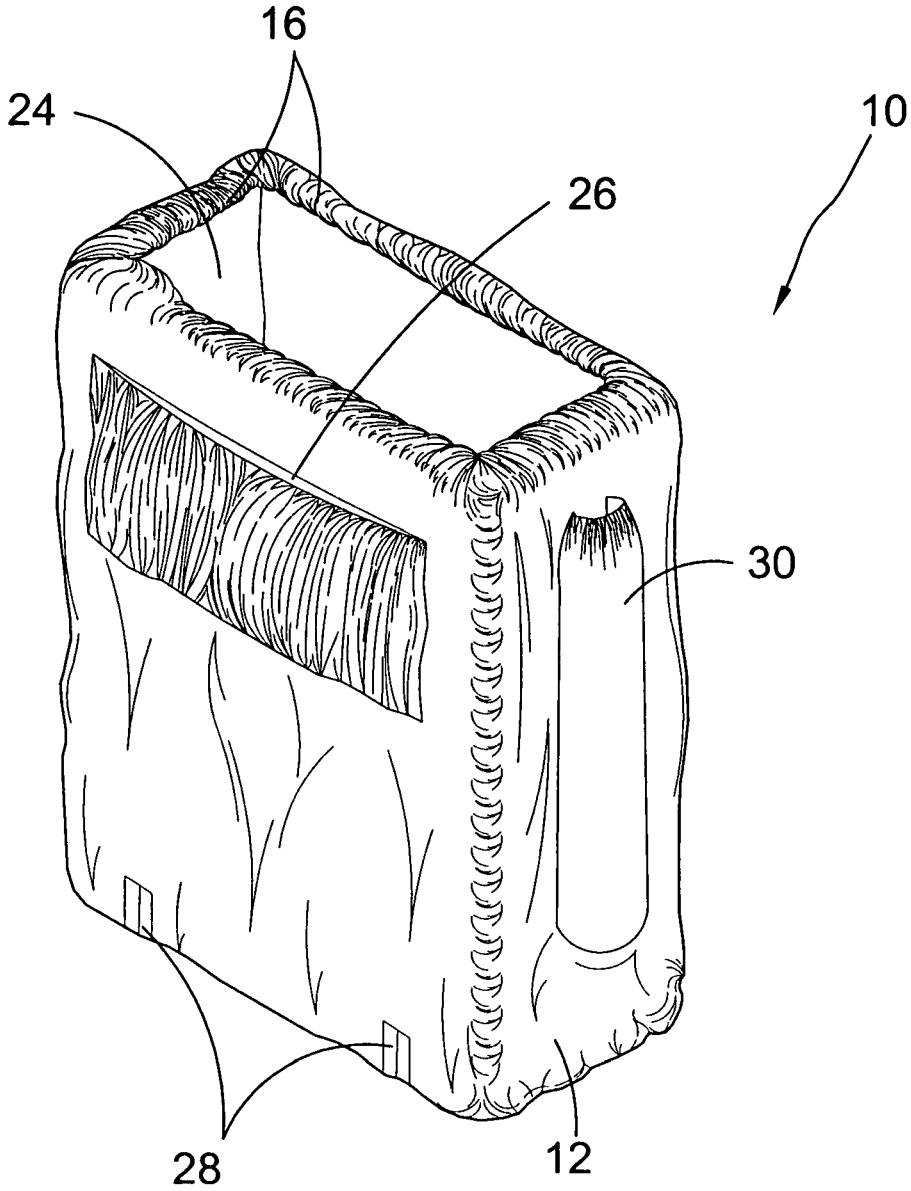
FIG. 3 is a rear perspective view of the present invention.

Turning to FIG. 3, shown therein is a rear perspective view of the present invention 10. Shown is a rear view of the present invention 10 comprising an easy to identify, flexible, foldable tubular like cover 12 open at 24 for suitcases having elastic 16 positioned within at least one distal end and having a slot for a handle, slot for wheels 28, a plurality of pockets, pouches and an umbrella pouch 30. The device allows a user to easily recognize their luggage at airports, bus terminals, train stations and hotels by the personal cover design of the device. The device is washable, lightweight and foldable for easy storage when not in use.

Figure 4:
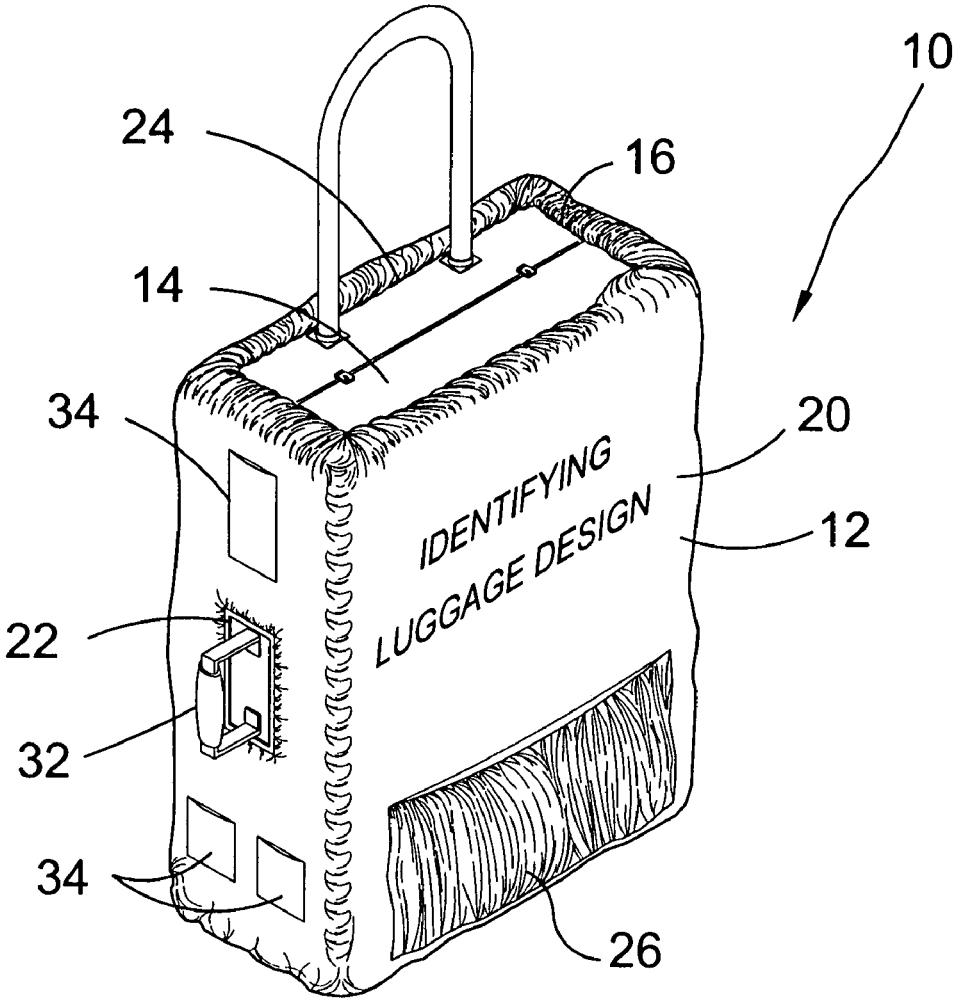
FIG. 4 is a front perspective view of the present invention having a suitcase therein.

Turning to FIG. 4, shown therein is a front perspective view of the present invention 10 having a suitcase 14 therein. Shown is a view of the present invention 10 comprising an easy to identify, flexible, foldable tubular like cover 12 open at 24 for suitcases 14 having elastic 16 positioned within at least one distal end and having a slot 22 for a handle 32, slot for wheels, a plurality of pockets 32, pouches 26 and an umbrella pouch. The device 10 allows a user to easily recognize their luggage at airports, bus terminals, train stations and hotels by the personal cover design at 20 of the device. The device 10 is washable, lightweight and foldable for easy storage when not in use.

Figure 5:
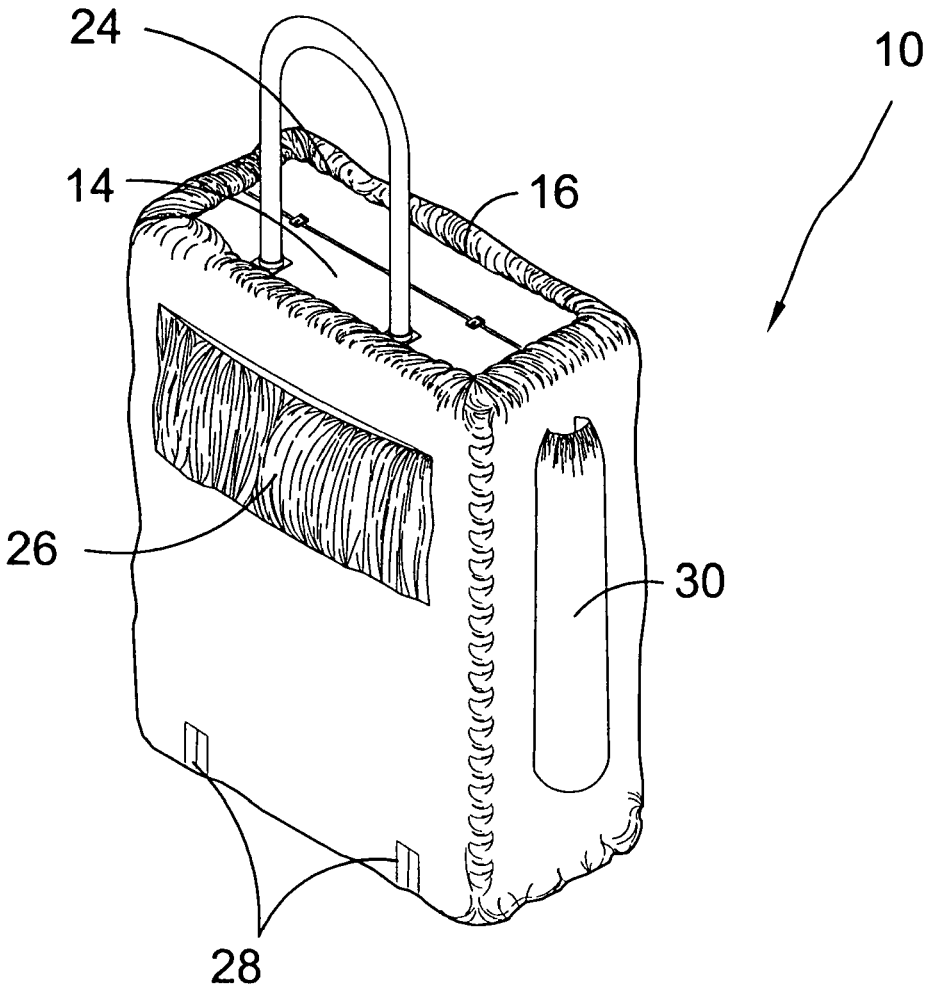
FIG. 5 is a rear perspective view of the present invention having a suitcase therein.

Turning to FIG. 5, shown therein is a rear perspective view of the present invention 10 having a suitcase 14 therein. Shown is a view of the present invention 10 comprising an easy to identify, flexible, foldable tubular like cover 12 open at 24 for suitcases 14 having elastic 16 positioned within at least one distal end and having a slot 28 for a handle, slot for wheels, a plurality of pockets, pouches 26 and an umbrella pouch 30. The device 10 allows a user to easily recognize their luggage at airports, bus terminals, train stations and hotels by the personal cover design of the device. The device 10 is washable, lightweight and foldable for easy storage when not in use.

Figure 6:
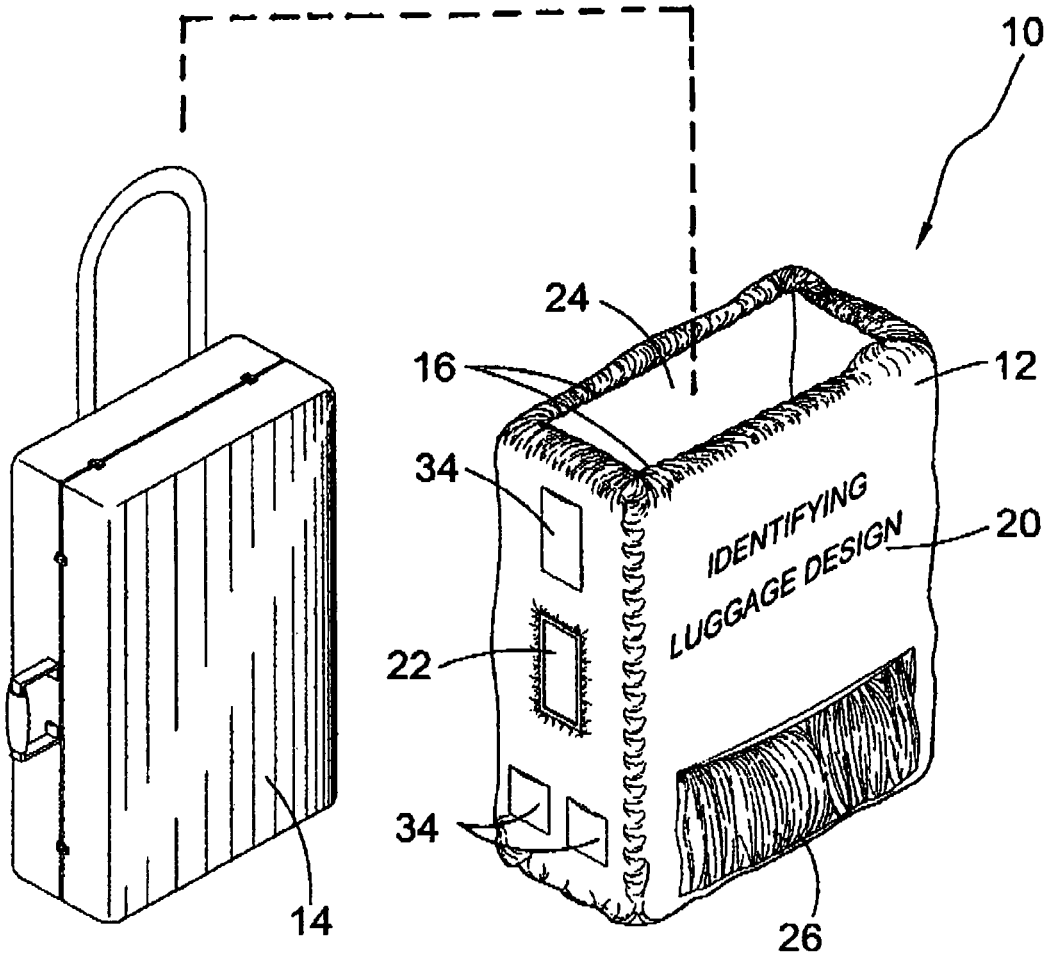
FIG. 6 is an exploded view of the present invention having a suitcase removed.

Turning to FIG. 6, shown therein is an exploded view of the present invention 10 having a suitcase 14 removed. Shown is a view of the present invention 10 comprising an easy to identify, flexible, foldable tubular like cover 12 open at 24 for suitcases 14 having elastic 16 positioned within at least one distal end and having a slot 22 for a handle, slot for wheels, a plurality of pockets 34, pouches 26 and an umbrella pouch. The device 10 allows a user to easily recognize their luggage at airports, bus terminals, train stations and hotels by the personal cover design 20 of the device. The device 10 is washable, lightweight and foldable for easy storage when not in use.

Figure 7:
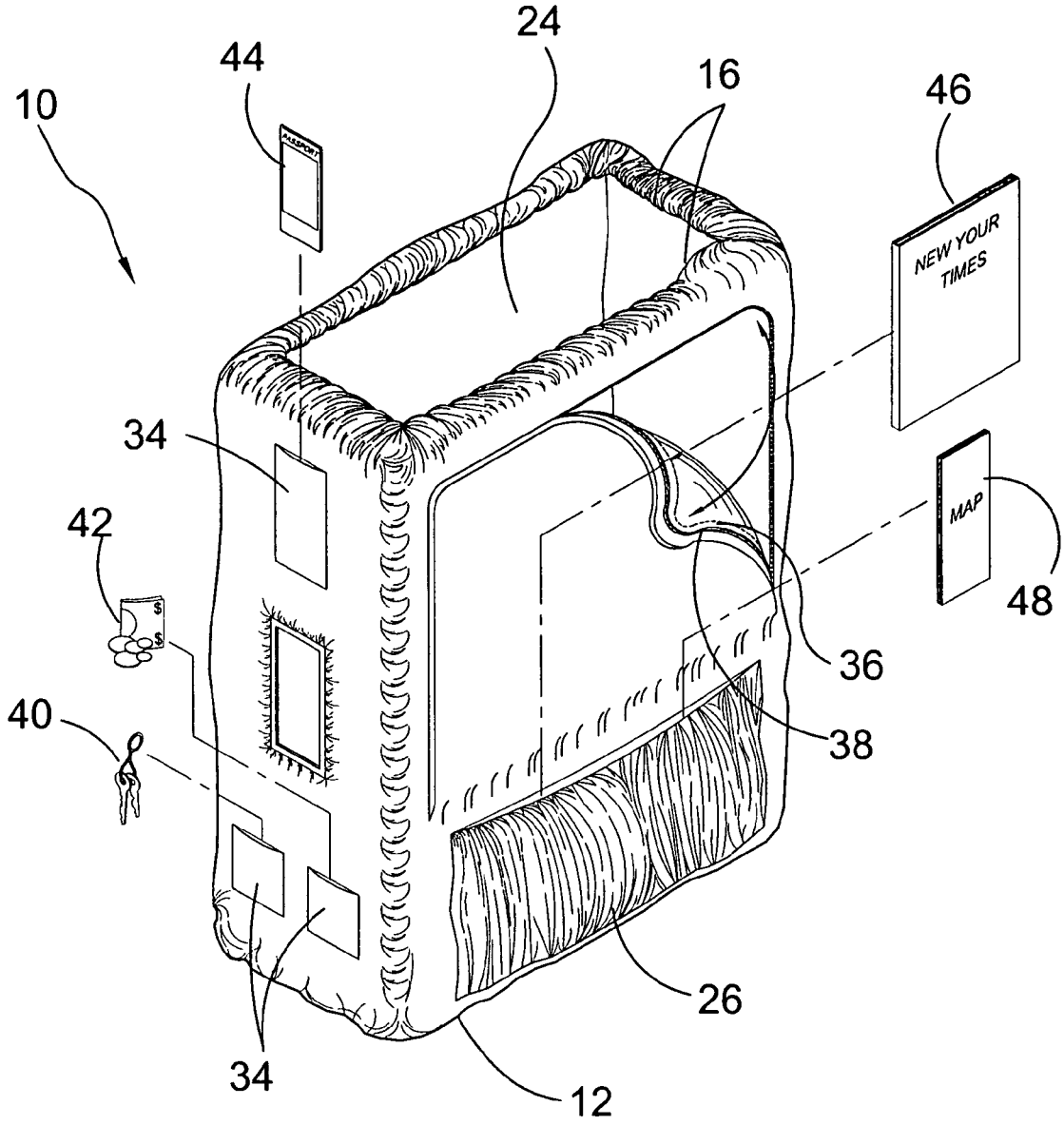
FIG. 7 is a perspective view of the present invention having storage pockets therein.

Turning to FIG. 7, shown therein is a perspective view of the present invention 10 having multiple storage pockets 34 therein. Shown is a view of the present invention 10 comprising an easy to identify, flexible, foldable tubular like cover 12 open at 24 for suitcases having elastic 16 positioned within at least one distal end and having a slot for a handle, slot for wheels, a plurality of pockets 34, pouches 26 and an umbrella pouch. The device 10 allows a user to easily recognize their luggage at airports, bus terminals, train stations and hotels by the personal cover design of the device. The device 10 is washable, lightweight and foldable for easy storage when not in use. Additionally shown is the present invention 10 having an access flap 36 with a zipper 38 to allow the user to access the suitcase therein without removing the present invention. Also shown are various articles for storage in the present invention 10, including keys 40, money 42, passport 44, magazines 46 and maps 48.

Figure 8:
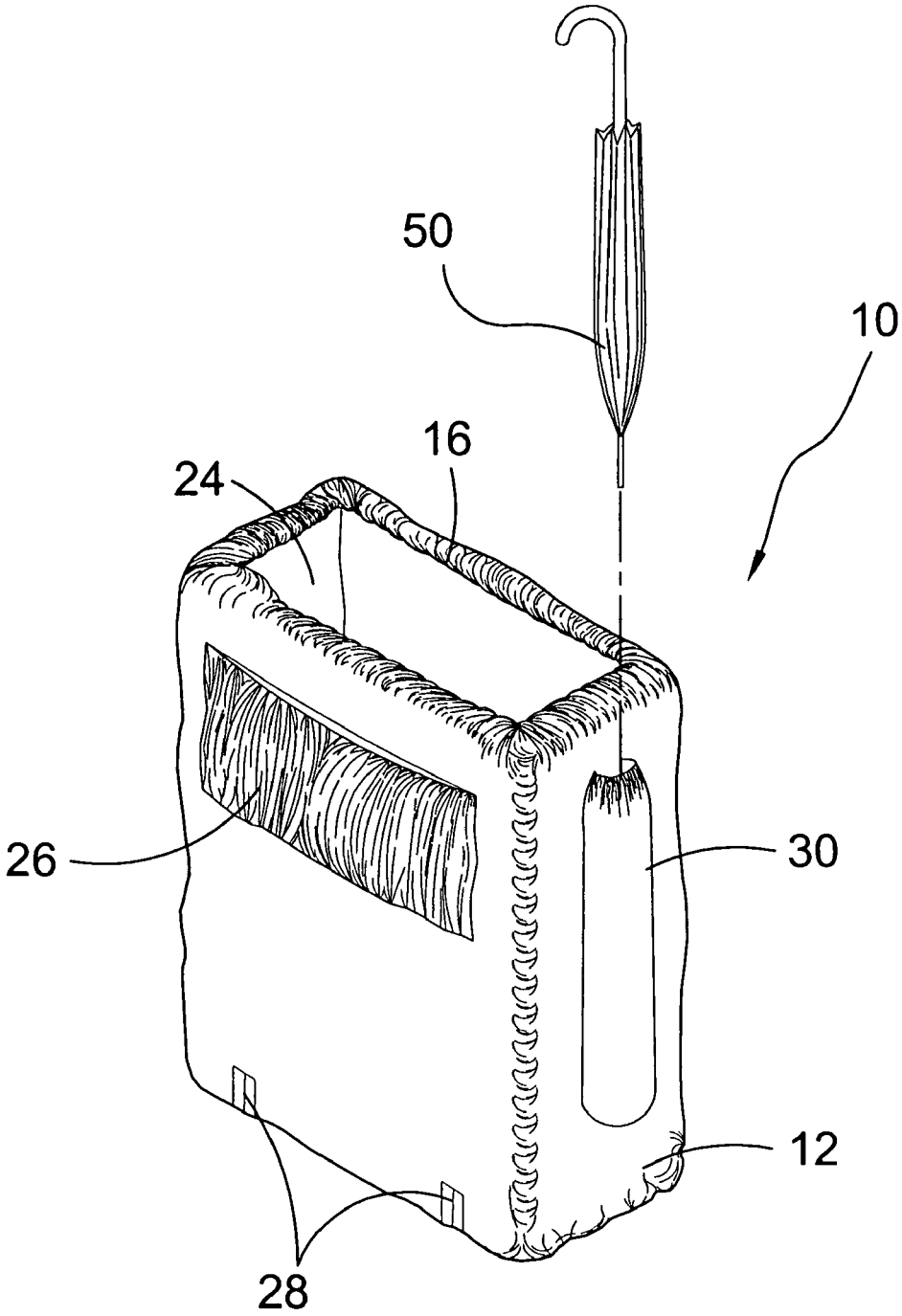
FIG. 8 is a perspective view of the present invention having storage pockets therein.

Turning to FIG. 8, shown therein is a perspective view of the present invention 10 having storage pockets therein. Shown is a view of the present invention 10 comprising an easy to identify, flexible, foldable tubular like cover 12 open at 24 for suitcases having elastic 16 positioned within at least one distal end and having a slot 28 for a handle, slot for wheels, a plurality of pockets, pouches 26 and an umbrella pouch 30 for umbrella 50. The device allows a user to easily recognize their luggage at airports, bus terminals, train stations and hotels by the personal cover design of the device. The device is washable, lightweight and foldable for easy storage when not in use.

Figure 9:
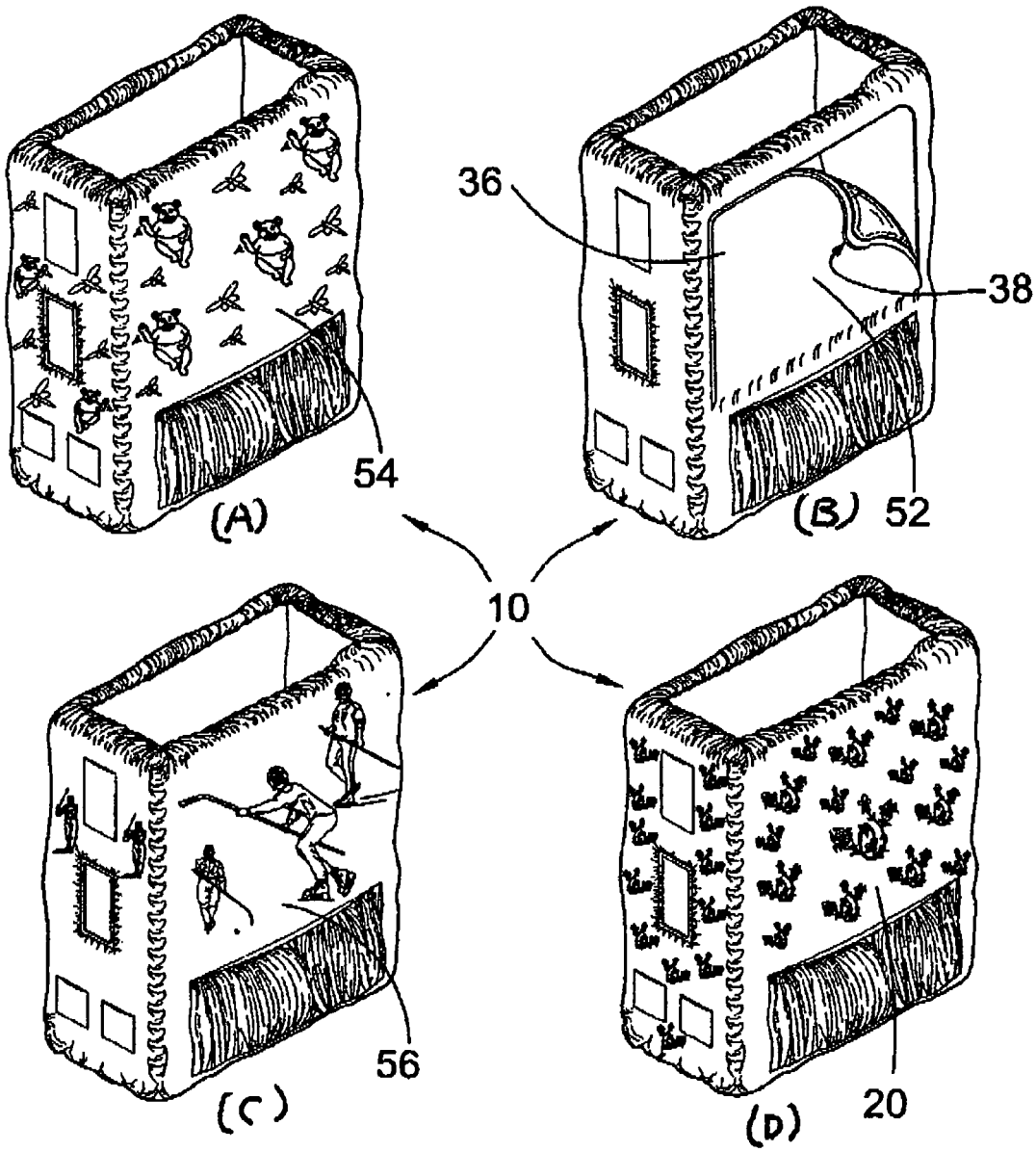

Turning to FIG. 9, shown therein is a plurality of possible designs of the present invention 10 for easy identification. Shown is a view of the present invention 10 comprising an easy to identify, flexible, foldable tubular like cover for suitcases having elastic positioned within at least one distal end and having a slot for a handle, slot for wheels, a plurality of pockets, pouches and an umbrella pouch. The device 10 allows a user to easily recognize their luggage at airports, bus terminals, train stations and hotels by the personal cover design 20 of the device. The device 10 is washable, lightweight and foldable for easy storage when not in use. Additionally shown is the present invention 10 having an access flap 36 with zipper 38 for the user's access to the luggage while covered. The design 20 may be colored at 52, have characters 54 or depict sports scenes 56.

Turning to FIG. 10, shown therein is a sectional view of the present invention's elastic band 16 having an inner elastic member 62 and an inner 58 and outer 60 cloth layer. Shown is a view of the present invention comprising an easy to identify, flexible, foldable tubular like cover for suitcases having elastic positioned within at least one distal end and having a slot for a handle, slot for wheels, a plurality of pockets, pouches and an umbrella pouch. The device 10 allows a user to easily recognize their luggage at airports, bus terminals, train stations and hotels by the personal cover design of the device. The device 10 is washable, lightweight and foldable for easy storage when not in use.

I claim:

1. A designer cover for a suitcase; comprising:

a) a flexible, cloth cover having opposing top and bottom ends, a front and rear surface and a pair of sides, said cover being tubular shaped being open on said top end to permit the cover to be placed over a suitcase by placing one end of the suitcase through the open end and sliding the cover over the suitcase, either of said front or rear surfaces of said cover having a flap to permit a user to open the flap of the cover and then to access the suitcase interior through the flap without removing the cover, a zipper being disposed around an edge of said flap to permit the flap to be opened and then reclosed, a handle for pulling said suitcase extending through the opening in the top end of said cover;

b) an elastic member being disposed around said open end of said cover wherein said elastic member secures said cover to the suitcase, said elastic member having an inner layer of cloth and an outer layer of cloth;

c) wherein said cover has at least one first aperture therein, said first aperture being disposed on said cover, wherein said first aperture receives the handle of the suitcase therein;

d) at least one pocket being disposed on said cover for placement of an article therein;

e) at least one pouch being disposed on said cover for placement of an article therein;

f) an identifying, colored design being disposed on either of said front or rear surfaces of said cover to permit a user to recognize the cover; and g) at least one elongated umbrella pouch being disposed on said cover for placement of an umbrella therein.

2. The cover of claim 1, wherein said identifying design comprises a sports scene to permit a user to recognize the cover.

* * * * *